US006141523A

United States Patent [19]

Bergmann et al.

[11] Patent Number: 6,141,523

[45] Date of Patent: Oct. 31, 2000

[54] ELECTROGRAPHIC PRINTING DEVICE WITH OPPOSITE-LYING PRINTING UNITS

[75] Inventors: Peter Bergmann, Oberding; Vilmar Eggerstorfer, Erding, both of Germany

[73] Assignee: Oce Printing Systems GmbH, Poing, Germany

[21] Appl. No.: 09/331,434

[22] PCT Filed: Dec. 18, 1997

[86] PCT No.: PCT/DE97/02979

§ 371 Date: Aug. 9, 1999

§ 102(e) Date: Aug. 9, 1999

[87] PCT Pub. No.: WO98/27466

PCT Pub. Date: Jun. 25, 1998

[30] Foreign Application Priority Data

Dec. 18, 1996 [DE] Germany ..... 196 52 862

[51] Int. Cl.[7] ..... G03G 15/22; G03G 15/01

[52] U.S. Cl. ..... 399/306; 399/299

[58] Field of Search ..... 399/306, 297, 399/298, 299

[56] References Cited

U.S. PATENT DOCUMENTS

| | | | |
|---|---|---|---|
| 4,427,285 | 1/1984 | Stange . | |
| 5,147,745 | 9/1992 | Russel . | |
| 5,579,089 | 11/1996 | Folkins . | |
| 5,809,388 | 9/1998 | Inada et al. | 399/306 X |
| 5,999,785 | 12/1999 | Vackier et al. | 399/306 |
| 6,032,015 | 2/2000 | Umeda et al. | 399/306 |
| 6,047,156 | 4/2000 | De Bock et al. | 399/298 |

FOREIGN PATENT DOCUMENTS

| | | |
|---|---|---|
| 0 433 444 B1 | 6/1990 | European Pat. Off. . |
| 0 629 924 A1 | 6/1994 | European Pat. Off. . |
| 0 742 496 A1 | 4/1996 | European Pat. Off. . |
| 33 01 124 A1 | 1/1983 | Germany . |
| 42 03 265 A1 | 2/1992 | Germany . |
| 42 04 470 A1 | 2/1992 | Germany . |
| 2-264276 | 10/1990 | Japan . |
| 4-181272 | 6/1992 | Japan . |
| 5-80632 | 4/1993 | Japan . |
| 7-209926 | 8/1995 | Japan . |
| 2 190 209 | 4/1987 | United Kingdom . |

*Primary Examiner*—Susan S. Y. Lee
*Attorney, Agent, or Firm*—Hill & Simpson

[57] ABSTRACT

An electrographic printing unit containing at least two printing units whose transfer printing points lie opposite one another is shown and described. This configuration enables high-speed duplex printing. Also disclosed is a printing unit with a photoconducting band and two exposure units located along the perimeter thereof. The exposure units superimpose two latent images each time the photoconducting band rotates.

23 Claims, 9 Drawing Sheets

ELECTROGRAPHIC PRINTING DEVICE WITH OPPOSITE-LYING PRINTING UNITS

FIELD OF THE INVENTION

The present invention is directed to an electrographic printer device, particularly a printer or a copier, comprising at least two essentially identical printing units with a transfer printing location each between which a carrier web to be printed is conducted. The invention is also directed to a method for the operation of a printer device.

BACKGROUND OF THE INVENTION

In a traditional printer device, a latent image is applied onto a toner image carrier with the assistance of an electrographic process, for example by exposing a photoconductor or by magnetization of a magnetically sensitive layer. Toner agglomerates at the latent image according to the image-related distribution of the electrical charges or of the magnetic poles. The toner is then transferred onto a carrier material, generally a paper web, at the transfer printing location. The toner image is later fixed on the carrier material.

There is a demand in modern printing technology that a single device print the carrier material on both sides with high speed. This operating mode is generally referred to as duplex printing. Further, there is a demand for the operating mode of spot color printing or two-color printing wherein printing is carried out in two colors on at least one side. Moreover, there is a need for a full-color printing with the four process colors. In order, for example, to realize the operating mode of duplex printing, it is known to initially print the continuous carrier web on one side, to then turn the carrier web over and to print the second side with the same printing unit. A web turn-over means is required given this solution. The conveying path of the carrier web through the printer is relatively long and requires a complicated conveyor mechanism for the carrier material that, thus, is also susceptible to malfunction.

A further disadvantage of the known printer is comprised therein that the toner image can smear when it has not yet been fixed on the one side of the carrier web and, thus, the printing quality is diminished or, respectively, a reject is produced. In order to avoid this, an intermediate fixing of the toner image can ensue, as a result whereof, however, the technical outlay becomes great. Moreover, the carrier web must traverse the fixing process a second time after being printed on the second side, as a result whereof is thermally highly stressed, shrinkage problems occur and the registration of the print is diminished. Due to the long conveying path between the first transfer printing location for the first transfer printing of a toner image and the second transfer printing location, adherence to a high registration of the carrier web can only be assured with great technological outlay.

The aforementioned problems also occur given what is referred to as a "twin system" wherein two identical printers are connected in series with one another in order to realize a two-sided printing, i.e. the duplex printing, while turning the carrier web over. In addition to the high costs for two printers, it is also disadvantageous that a large basement surface must be made available and the apparatus control of the two printers must be adapted to one another with relatively high technological outlay.

EP 0 629 931 A1 (Applicant: XEIKON) discloses an electrostatic printer wherein a carrier web is conducted through between a plurality of toner image carrier in vertical direction. Each toner image carrier has a means that generates a toner image. The toner is transferred onto the carrier web at a respective transfer printing location of the toner image carriers. As a result of the both-sided arrangement of toner image carriers along the vertically proceeding carrier web, duplex printing with different toner colors is possible. The known apparatus has a complicated structure, a complicated carrier material guidance and is bulky.

EP 0 433 444 B1 (Applicant: Eastman Kodak Company) discloses a printer wherein a plurality of developer stations are arranged along a photoconductive band as toner image carrier. Each developer station can provide the charge image generated by an illumination station with toner having a predetermined color. The toner image generated on the photoconductive band is then transferred onto the carrier material at a single transfer printing location. This printer is also technologically complicated and can realize only low printing speeds in the various operating modes.

EP-A-0 629 924 discloses a printer device according to the preamble of claim 1. A photoconductor band can also be employed as photoconductor or, respectively, toner carrier.

EP-A-0 742 496 discloses an electrographic printer device, particularly a printer or copier, having at least two essentially identical printing units. A carrier web is conducted through between the printing units arranged lying opposite one another and is printed. The printing units enable a multi-color printing.

Patent Abstracts of Japan, Volume 15, No. 20 (P1154), Jan. 17, 1991, Pub. No. JP-A-02264276, discloses a printer device wherein a repeating mode is realized. This printer device prints single sheets on only one side. The single sheets are moved back and forth in the repeating mode. The photoconductor band is brought into contact both with a developing unit as well as with the single sheets in the one motion direction. When moving the single sheets in the other direction, the photoconductor band is moved away both from the signle sheets as well as from the developing unit.

Therefore, there is a need for an electrographic printer device that works with high printing speed and has a compact structure. Further, high flexibility in view of various types of printing mode should be achieved.

SUMMARY OF THE INVENTION

According to the present invention, an electrographic printer device comprising at least two essentially identical printing units each having a transfer printing location is recited between which a carrier web to be printed is conducted. The transfer printing locations are arranged lying opposite one another with slight lateral offset in moving direction of the carrier web. Each printing unit has a toner carrier band on whose endless circumferential surface toner can be applied according to an image-shaped distribution, said toner being transferrable at the respective transfer printing location onto the surface of the carrier web lying opposite it.

In the present invention, toner is transferred onto a toner carrier band that carries a latent image on its endless circumferential surface. Any band that can generate a latent charge image in a magnetic or electric way can be employed as toner carrier band. A photoconductor band is preferably employed that generates an electrical charge image by illumination, whereby toner particles agglomerate on the circumferential surface of the photoconductive band during developing according to the charge distribution. An elongated loop can be produced with the assistance of the toner carrier band, this making it possible that the units required for generation of a toner image can be arranged distributed along the length of the toner carrier band. In this way, a compact arrangement of two toner carrier webs is possible, their transfer printing locations being arranged lying opposite one another, so that a single printer can contain two printing units without creating a bulky device. As a result of employing toner carrier webs in the printing units, further, it is possible to arrange the two transfer printing locations lying opposite one another slight lateral offset relative to one another. Preferably, the lateral spacing of the two transfer printing locations from one another is only limited by the dimensions of the transfer printing corona means to be arranged between the transfer printing locations. In this way, the two transfer printing locations are moved close to one another, so that the transport path for the carrier web between these transfer printing locations is minimal. A high registration for the print images generated by the two printing units is thus achieved.

When, given the invention, both printing units work in printing mode, then the operating mode of duplex printing can be realized with high speed. A turn-over of the carrier web is not required. Since the two transfer printing locations are arranged at a slight spacing from one another, the registration of the print images is not influenced by shrinkage processes, variation of moisture, etc.

The carrier web is conducted on a straight path between the transfer printing locations. The toner images applied by the two printing units are no longer contacted by any guide elements until they have passed through a fixing process. As a result thereof, the risk of a smearing of the as yet non-fixed toner images is precluded, and a high printing quality is achieved.

One exemplary embodiment of the invention is characterized in that the carrier web proceeds essentially horizontally. This horizontal arrangement has the advantage that an operator can look from above onto the carrier web for checking the print image. The checking person thereby assumes a natural and comfortable posture.

In the present invention, each printing unit contains a swivel mechanism with which the photoconductor band can be swivelled away from the carrier band and can be swivelled in against the carrier band. As a result of these measures, the carrier band itself need not be moved given a start and stop mode. Corresponding technical devices can thus be eliminated. When swivelling the photoconductor band, the length of the photoconductor band is not changed. As a result thereof, the risk of smearing in the print image is reduced. When the swivelling mechanism is swivelled away, moreover, it is possible to collect a plurality of toner images on the photoconductor band and to transfer-print these later in common.

According to one exemplary embodiment having a photoconductor band as toner image carrier, the outer circumferential surface of the photoconductor band can be completely charged with a latent charge image. The employment of a circulating, endless photoconductor band is known in and of itself for single-sheet printers. Such a photoconductor band has a seam at which no charge image can be produced. This seam is usually identified by an index hole and is taken into consideration by the illumination unit of the device controller during illumination. When delivering single sheets, it is then assured that the seam is always located between two ends of successive single sheets, so that the seam is not visible in the print image. Given the employment of band material as carrier material, the seam is optimally small or, respectively, no seam is present according to the exemplary embodiment. The photoconductor band can thus be completely coated with photo-active material, so that it can be completely charged with a latent charge image along its circumferential surface. In this way, the band material can be printed without interruption—no printing gap arises.

According to a further exemplary embodiment, the first and/or second means generating a toner image respectively contains a plurality of developer stations. When these developer stations have toner with different colors, a multi-color printing is possible. This multi-color printing can be a spot color printing in a simple case or, given corresponding process management, can be a full-color printing with the process colors of yellow, magenta, cyan and black.

A repeating mode can be provided for applying different toner images, whereby the carrier material is repeatedly conducted past the transfer printing locations on the basis of a forward motion and a reverse motion. Given every pass in forward direction, a toner image is transferred onto the carrier material. In this way, toner images of different color that are generated on the photoconductor band by the various developing stations of a circumferential section can be collected on the carrier material and can be subsequently fixed in common. During every reverse motion, the photoconductor band is swivelled away from the carrier web, so that the applied toner image or, respectively, the applied toner images are not smeared.

According to a further aspect of the invention, a method is recited for operating an electrographic printer device. In continuous mode, a fast transfer printing with at least one color is possible. In repeating mode, a retarded transfer printing with a plurality of colors is possible.

In an embodiment, the present invention provides an electrographic printer device comprising at least two printing units each comprising a respective transfer printing location between which a carrier web to be printed is conducted, the transfer printing locations being disposed opposite the web from one another and laterally offset from one another, each printing unit further comprising a toner carrier band comprising an endless outer circumferential surface that extends around its respective transfer printing location and on which toner can be applied in an image-shaped distribution, the toner being transferrable from the toner carrier band to the carrier web at the respective transfer printing location as the carrier web passes the respective toner carrier band at the respective transfer printing location, each printing unit further comprising a swivel mechanism at least partially disposed inside the toner carrier band for moving the toner carrier band away from the carrier web only at the transfer printing location, each printing unit further comprising a tensioning element disposed inside the toner carrier band for applying tension to the toner carrier band.

In an embodiment, the carrier web is conducted horizontally.

In an embodiment, the toner carrier bands of the two printing units each form an elongated loop, each longitudinal loop having a longitudinal axis, the longitudinal axes of the two loops extending vertically.

In an embodiment, each toner carrier band forms an elongated loop, each longitudinal loop having a longitudinal axis, the longitudinal axes of the two loops extending at an angle of 15° with respect to vertical, and the longitudinal axes are parallel to one another.

In an embodiment, each toner carrier band is a photoconductor band and the outer circumferential surface of each toner carrier band can be completely charged with a latent charge image.

In an embodiment, each printing unit further comprises at least one illumination unit selected from the group consisting of a laser illumination unit and a LED illumination unit.

In an embodiment, each printing unit further comprises a deflection drum disposed inside the toner carrier band and at an opposing end of the toner carrier band from the transfer printing location and the illumination unit of each printing unit is disposed opposite the toner carrier band from the deflection drum.

In an embodiment, each printing unit further comprises a plurality of developer stations.

In an embodiment, each printing unit further comprises four developer stations, each developer station accommodating toner in four process colors for full-color printing.

In an embodiment, the carrier web can conducted past the respective transfer printing locations with a forward motion and a reverse motion, and a toner image is transferred onto the carrier web given every passage in forward direction.

In an embodiment, the toner carrier band is moved away from the carrier web given every reverse motion thereof.

In an embodiment, the printer device further comprises a pair of further printing units disposed on opposing sides of the carrier web and downstream of said at least two printing units.

In an embodiment, the printer device further comprises a fixing means that fixes a toner image on the carrier web.

In an embodiment, the fixing means comprises a horizontal fixing path.

In an embodiment, the fixing means comprises a vertical fixing path.

In an embodiment, each printing unit comprises at least two illumination units, at least two charging corona devices and at least two developer stations, the illumination units, charging corona devices and developer stations being disposed along the outer circumference of their respective toner carrier bands, the illumination units generating two latent images on their respective toner carrier band that can be superimposed on one another and that can be successively coated with toner by the respective developer stations.

In an embodiment, the toners distributed by the developer stations are of different colors.

In an embodiment, each printing unit further comprises a transfer printing corotron disposed at the transfer printing location, and a conditioning corotron disposed adjacent to and upstream of the transfer printing corotron as viewed in conveying direction of the carrier web.

In an embodiment, each printing unit further comprises a transfer printing corotron disposed at the transfer printing location, and a conditioning corotron disposed adjacent to and downstream of the transfer printing corotron as viewed in conveying direction of the carrier web.

In an embodiment, each toner carrier band is moved away from the carrier web by its respective swivel mechanism, a plurality of toner images are collected on the toner carrier band which are subsequently transfer-printed onto the carrier web as superimposed toner images.

In an embodiment, the present invention provides a method for operating an electrophotographic printer device that includes at least two printing units each comprising a respective transfer printing location between which a carrier web to be printed is conducted, the transfer printing locations being disposed opposite the web from one another and laterally offset from one another, each printing unit further comprising a toner carrier band comprising an endless outer circumferential surface that extends around its respective transfer printing location and on which toner can be applied in an image-shaped distribution, the toner being transferrable from the toner carrier band to the carrier web at the respective transfer printing location as the carrier web passes the respective toner carrier band at the respective transfer printing location, each printing unit further comprising a swivel mechanism at least partially disposed inside the toner carrier band for moving the toner carrier band away from the carrier web only at the transfer printing location, each printing unit further comprising a tensioning element disposed inside the toner carrier band for applying tension to the toner carrier band, each printing unit further comprising a plurality of developer stations, the method comprising the following steps: supplying a carrier web to the printing units, applying toner to the outer circumferences of the toner carrier bands in image-shaped distributions, conducting the toner carrier band past the transfer printing location in a forward direction, transferring toner from each toner carrier band to the carrier web at each respective transfer printing location, moving the toner carrier bands away from the carrier web only at the transfer printing locations with the respective swivel mechanisms, conducting the toner carrier bands past the transfer printing locations in a reverse direction, moving the toner carrier bands towards the carrier web only at the transfer printing locations with the respective swivel mechanisms, conducting the toner carrier band past the transfer printing location in a forward direction, transferring toner from each toner carrier band to the carrier web at each respective transfer printing location, applying tension to the toner carrier bands when they are moving in both the forward and reverse directions.

In an embodiment, each printing unit comprises four developer stations having toner in four process colors for full-color printing.

In an embodiment, a turn-over means disposed between two printing units for turning the carrier web over.

Other objects and advantages of the present invention will become apparent from reading the following detailed description and appended claims, and upon reference to the accompanying drawings.

BRIEF DESCRIPTION OF THE DRAWING

Exemplary embodiments of the invention are explained below with reference to the drawing. Shown therein are.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
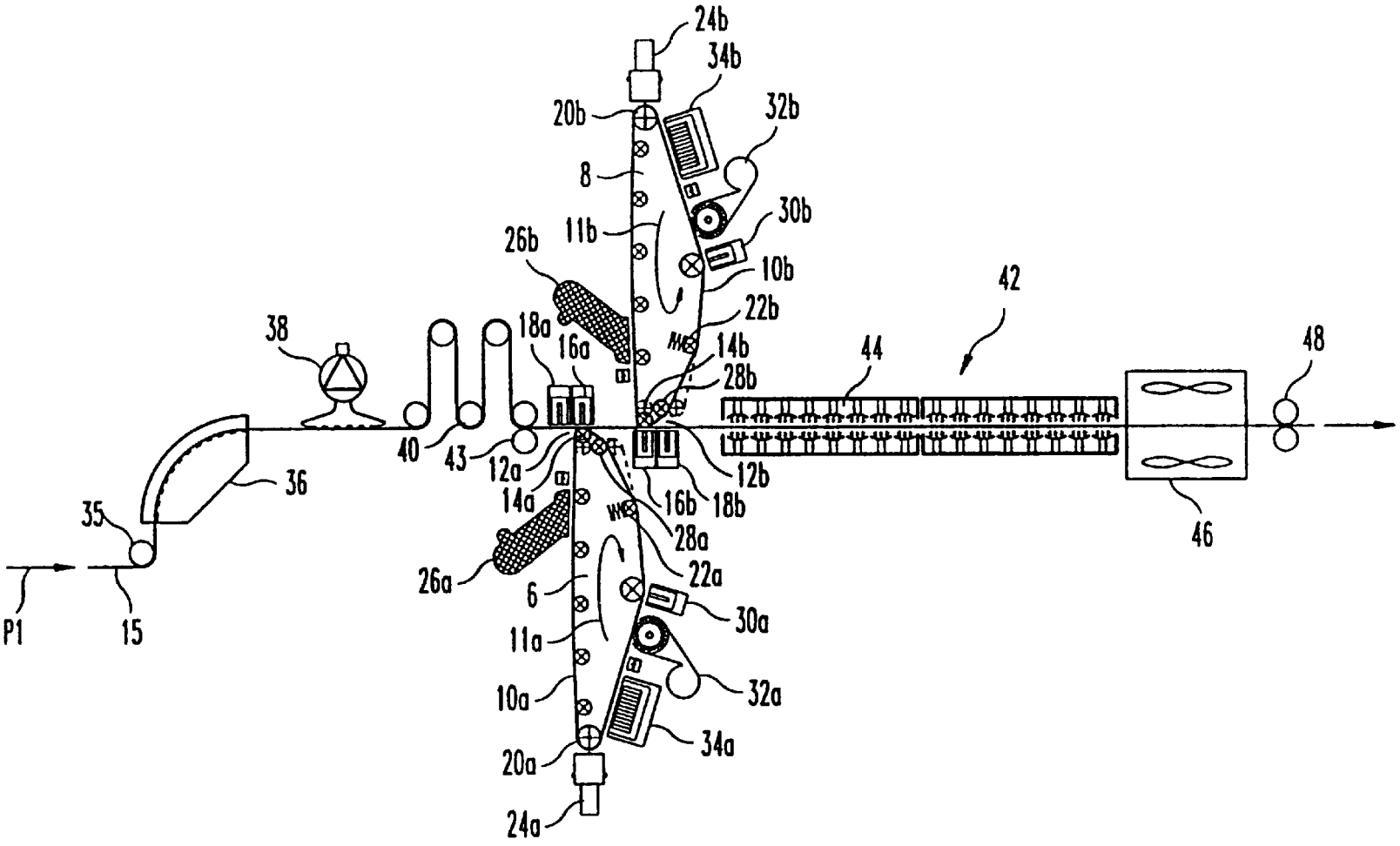
FIG. 1 is a schematic view of schematically, the electrographic printer device having two printing units residing opposite one another.

FIG. 1 schematically shows a printer means of the invention. The printer means contains two printing units 6, 8 that are identically constructed. Only the lower printing unit 6 is explained below, the units thereof being referenced by the reference character with the addition of an "a". The same units are also employed in the upper printing unit 8 but are referenced thereon with the corresponding reference character and the letter "b".

The printing unit 6 has a photoconductor band 10*a* whose endless circumferential surface can be completely charged with a latent charge image. The photoconductor band 10*a* is conducted past a transfer printing location 12*a* given rotational movement in the direction of the arrow 11*a* in order to transfer toner onto a continuous paper web 15. A transfer drum 14*a* has a transfer printing corotron 16*a* allocated to it that deposits the toner particles on the photoconductor band 10*a* due to the influence of an electrostatic force field on the paper web 15, so that a toner image that is not yet smear-proof arises on the paper web 15. As viewed in conveying direction of the paper web 15, a conditioning corotron 18*a* precedes the transfer printing corotron 16*a,* said conditioning corotron 18*a* placing the paper web 15 in to a defined electrostatic initial condition.

A deflection drum 20*a* that deflects the photoconductor web 10*a* is arranged lying opposite the transfer drum 14*a*. The photoconductor web 10*a* is fashioned as an elongated loop whose longitudinal axis proceeds essentially vertically. As a result thereof, it is possible to arrange the units necessary for the generation along this longitudinal axis at both sides of the photoconductor web 10*a*, as a result whereof it is possible to arrange the two transfer printing locations 12*a* and 12*b* with slight lateral offset in conveying direction of the paper web 15. The length of the photoconductor band 10*a* is selected such that adequate space remains for said units.

As can be seen in FIG. 1, the photoconductor band 10*a* is guided on a plurality of drums (not referenced in detail), including the drums 14*a* and 20*a*. A tension element 22*a* can be switched into two positions. In the one position, the photoconductor band 10*a* is tensed. In the other position, the mechanical tension of the photoconductor band 10*a* is reduced. In this position, the photoconductor band can be replaced or maintenance work can be undertaken.

An illumination unit that contains light-emitting diodes and is also referred to as a LED illumination unit and that is fashioned as character generator 24*a* is arranged at the deflection drum 20*a*. The character generator 24*a* generates a latent charge image on the photoconductor band 10*a* with a charge distribution according to the characters or picture elements to be printed. As viewed in rotational direction, a developer station 26*a* is provided following the character generator 24*a,* this inking the charge image with toner. This toner image, as mentioned, is transferred onto the underside of the paper web 15 at the transfer printing location 12*a*.

In start-stop mode, the photoconductor band 10*a* must be pivoted away from the paper web 15. To this end, a swivelling mechanism 28 is provided that holds the photoconductor band 10*a* either in the position entered with solid lines in FIG. 1 or in the position entered with broken lines. In the position entered with broken lines, the photoconductor band 10*a* is swivelled away from the paper web 16; a transfer of toner is impossible. It should be noted that the swivelling of the photoconductor band 10*a* ensues without modifying the length of the photoconductor band, so that the electrophotographic process, for example the exposure of the photoconductor band, need not be interrupted. The tensioning element 22*a* likewise serves this purpose, this being adjustable into two positions dependent on the swivelled position of the swivelling mechanism 28*a*. In each of these positions, the photoconductor band 10*a* is held under tension. It should also be pointed out that, in the position of the swivelling mechanism 28*a* swivelled away from the paper web 16, it is possible to collect a plurality of toner images on the photoconductor band 10*a* in order to then transfer-print superimposed toner images. This operating mode shall be explained later.

A cleaning corotron 30*a* and a cleaning station 32*a* are arranged following the transfer printing corotron 16*a* as viewed in rotational sense of the photoconductor band 10*a*. Both units have the job of removing toner from the photoconductor band 10*a* that is still present after the printing at the transfer printing location 12*a* in order to place the photoconductor band 10*a* into a defined initial condition for the following illumination and toner pick-up. A charging corotron 34*a* that generates a defined charge state on the surface of the photoconductor band 10*a* is arranged preceding the character generator 24*a*. The process of charge image generation and inking with toner is known in and of itself and need not be explained in detail here.

As mentioned, the upper printing unit 8 has the same structure as the printing unit 6 that has been explained. Its units identified with the addition of a "b" therefore need not be explained again. Only the conditioning corotron 18*b* need be mentioned, this placing the paper web 15 into a largely neutral electrostatic state after the both-sided printing by the printing units 6, 8.

The transport of the paper web 15 through the printer device is described below. The paper web 15 is supplied to a transverse alignment means 36 via a deflection roller 35 in the direction of the arrow P1, this transverse alignment means 36 roughly aligning the paper web 15 in the direction transverse relative to the conveying direction P1. Subsequently, the paper web 15 is conducted past an under-pressure brake 38 that suctions the paper web 15 with under-pressure in order to keep the longitudinal tension in it at a defined value. The paper web 15 then passes through a lateral guidance means 40 that controls an exact lateral guidance of the paper web 15 for the following transfer printing at the printing units 6, 8. With reference to the lateral guidance, the transverse alignment means 36 serves for the rough alignment, and the lateral guide means 40 serves for the fine, lateral alignment of the paper web 15.

A friction roller pair 43 serves the purpose of conveying the paper web 15 forward. The paper web 15 runs on a straight-line path horizontally past the transfer printing locations 12*a,* 12*b* and is printed thereat in simplex printing mode by the upper printing unit 8 and by both printing units 6, 8 in duplex printing mode. In simplex printing mode, thus, the printing unit 6 is deactivated in order to print the toner image on the upper side of the paper web 15. This has the advantage that an operator can check the upper side upon establishment of the print image. However, it is also conceivable to deactivate the upper printing unit 8 for the simplex printing mode and to accomplish the printing with the lower printing unit 6.

One advantage of the selected arrangement is that, given outage of one printing unit, for example of the printing unit 6, the other printing unit, for example the printing unit 8 can maintain the simplex printing mode.

The paper web 15 provided with toner images proceeds into a fixing device 42 having an elongated, horizontally proceeding fixing path 44. In the present case, the fixing device 42 works with infrared radiation. However, a fixing device can also be utilized that realizes a hot-pressure fixing with two rollers that press against one another. In duplex printing mode, the toner images applied onto both sides of the paper web 15 are simultaneously fixed. What is critical is that no mechanical contact with the toner images on the paper web 15 occurs between the last transfer printing location 12*b* and the passage through the fixing zone. This means that the paper web 15 must be kept in a tensed condition, this being achieved by the transport roller pair 48 that transports the paper web 15 under tension. The fixing device 42 is followed by a cooling device 46 that cools the heated paper web 15.

As can be derived from the exemplary embodiment according to FIG. 1, a duplex printing mode can ensue with the same speed as a simplex printing mode. Since the two transfer printing locations 12*a* and 12*b* reside nearly opposite one another or, respectively, are arranged at a slight lateral distance from one another, the registration of the print images that are produced is extremely high, i.e. an optimum printing quality is achieved.

In the example of FIG. 1, the transport of the paper web 15 ensues without engagement into a margin perforation of the paper web. Of course, however, a paper transport with engagement into a margin perforation of the paper web 15 can also ensue. Tractor drives are then utilized for the paper transport, these engaging into the margin perforations of the paper web 15 with transport burrs. The edge-precise guidance of the paper web 15 is assured in this way and components such as transverse alignment means, lateral guidance means, under-pressure brake, suction table can be omitted.

As a result of the short paper path between the two transfer printing locations 12*a* and 12*b*, a high registration of the toner images to be printed is established. An intermediate storing of data for the character generators 24*a* and 24*b* can therefore be omitted. The illumination of the photoconductor band 10*a* or, respectively, 10*b* ensues merely time-offset by a time that derives from the conveying velocity and the paper path between the two transfer printing locations 12*a* and 12*b*.

Figure 2:
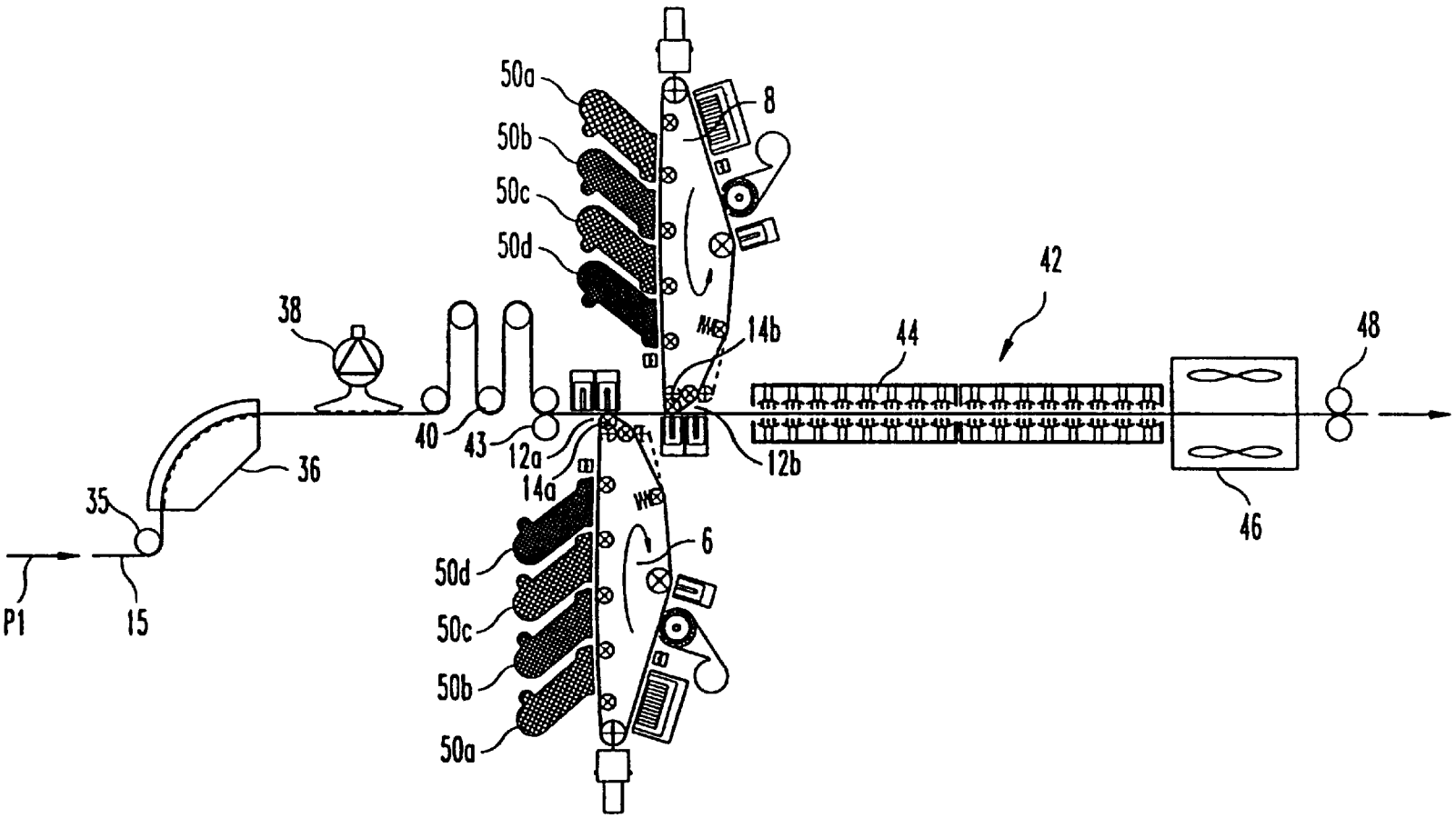
FIG. 2 is another schematic view of the arrangement according to FIG. 1, whereby the printing units contain a plurality of developer stations.

FIG. 2 schematically shows a printer device that coincides with that of FIG. 1 in terms of critical parts. The two printing units 6, 8, however, contain a plurality of developer stations 50*a*, 50*b*, 50*c*, 50*d*. In a repeating mode, i.e. with forward motion and reverse motion of the paper web at the transfer printing locations 12*a*, 12*b*, a plurality of toner images can be collected on top of one another on the paper web 15 dependent on the plurality of developer stations employed, four developer stations 50*a* through 50*d* in the present case. The printing speed given this operating mode decreases corresponding to the required forward and reverse motion. The fixing of all superimposed toner images ensues in common in the single fixing device 42. The transfer drums 14*a*, 14*b* are to be pivoted away from the paper web 15 given every reverse motion thereof in order to avoid a smearing of the as yet unfixed toner images. Given employment of known process colors, yellow, magenta, cyan and black, as toner in the developer stations 50*a* through 50*d*, a full-color printing can be produced in simplex printing mode or in duplex printing mode given appropriate process management.

Figure 3:
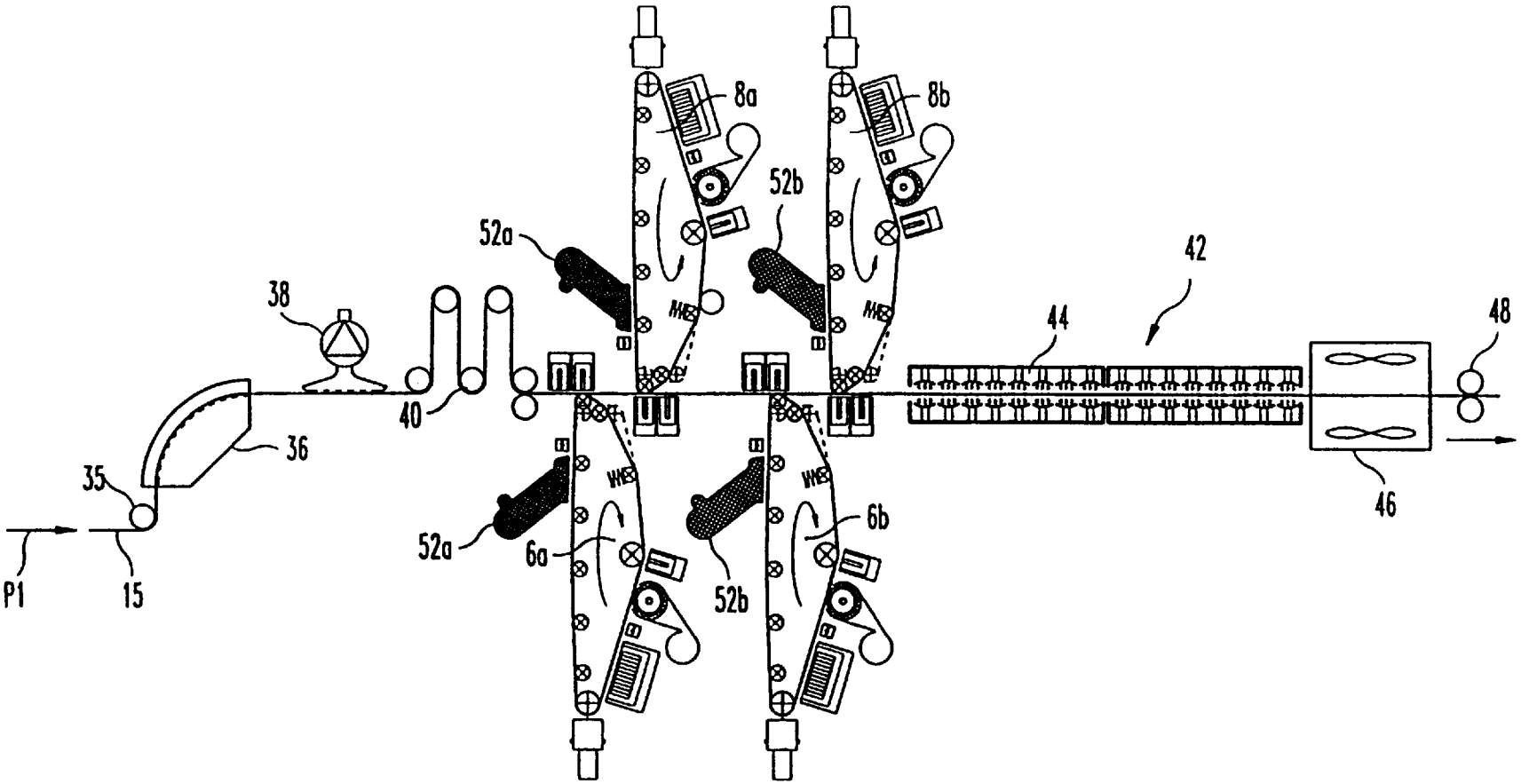
FIG. 3 is a schematic view of a printer means having two pair of identical printing units.

FIG. 3 shows a further version of the printer device according to the invention. Two pair of printing units 6*a*, 8*a* and 6*b*, 8*b* are connected in series. Each pair of printing units 6*a*, 8*a* and 6*b*, 8*b* essentially has the structure shown in FIG. 1. Fast two-color duplex operation, in particular, is possible with the arrangement shown in FIG. 3. To this end, a toner image with a first color is printed on the underside by the printing unit 6*a* of the developer station 52*a*. Subsequently, the lower printing unit 6*b* of the second pair of printing units applies a second toner image onto the paper web 15 with the developer station 52*b*. The upper side of the paper web 15 is analogously printed by the printing units 8*a* and 8*b*. The toner images of both sides of the paper web 15 are fixed in common in the single fixing device 42.

Figure 4:
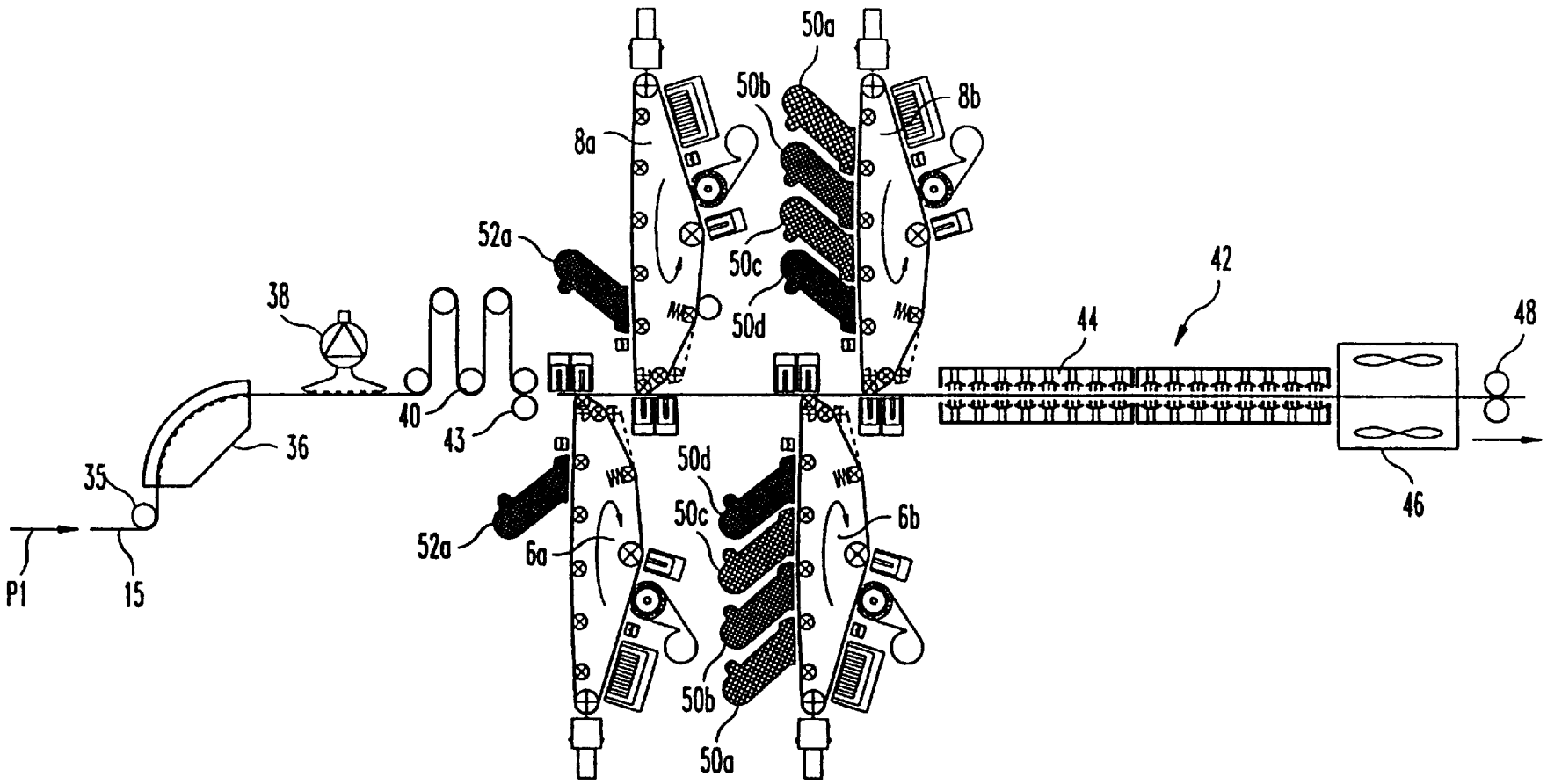
FIG. 4 a printer means whose pairs of printing units are different.

FIG. 4 shows a further version with printing units according to FIG. 3 arranged paired. The printing unit pair having the printing units 6*b*, 8*b* which are equipped with four developer stations 50*a* through 50*d*, as likewise shown in FIG. 2. The printing units 6*a*, 8*a* correspond to those of FIG. 1. The arrangement of FIG. 4 can be advantageously utilized for alternating duplex printing mode, two-color duplex printing mode and a multi-color duplex mode. Given a continuous motion of the paper web 15, a toner image of a first color can be applied on both sides by the first printing unit pair 6*a*, 8*a* with the developer stations 52*a*. When the printing unit pair 6*b*, 8*b* is deactivated, then a single-color duplex printing mode is realized. When the printing unit pair 6*b*, 8*b* is activated, then, given a fast, continuous passage of the paper web 15, a two-color duplex mode can be realized in that one of the developer stations 50*a* through 50*d* applies a toner image with a corresponding color onto the respective photoconductor band 10*a*, 10*b*. A multi-color duplex printing mode can be realized with different toner colors of the printing units 6*a*, 8*a* and 6*b*, 8*b*. Given repeating mode, a multi-color duplex printing mode can be realized according to the developer stations 50*a* through 50*d* present in the printing units 6*b*, 8*b* and according to the toner colors. A rapid change without mechanical readjustments can be made between the operating mode with continuous printing operation (without repetition) and the repeating printing mode.

Figure 5:
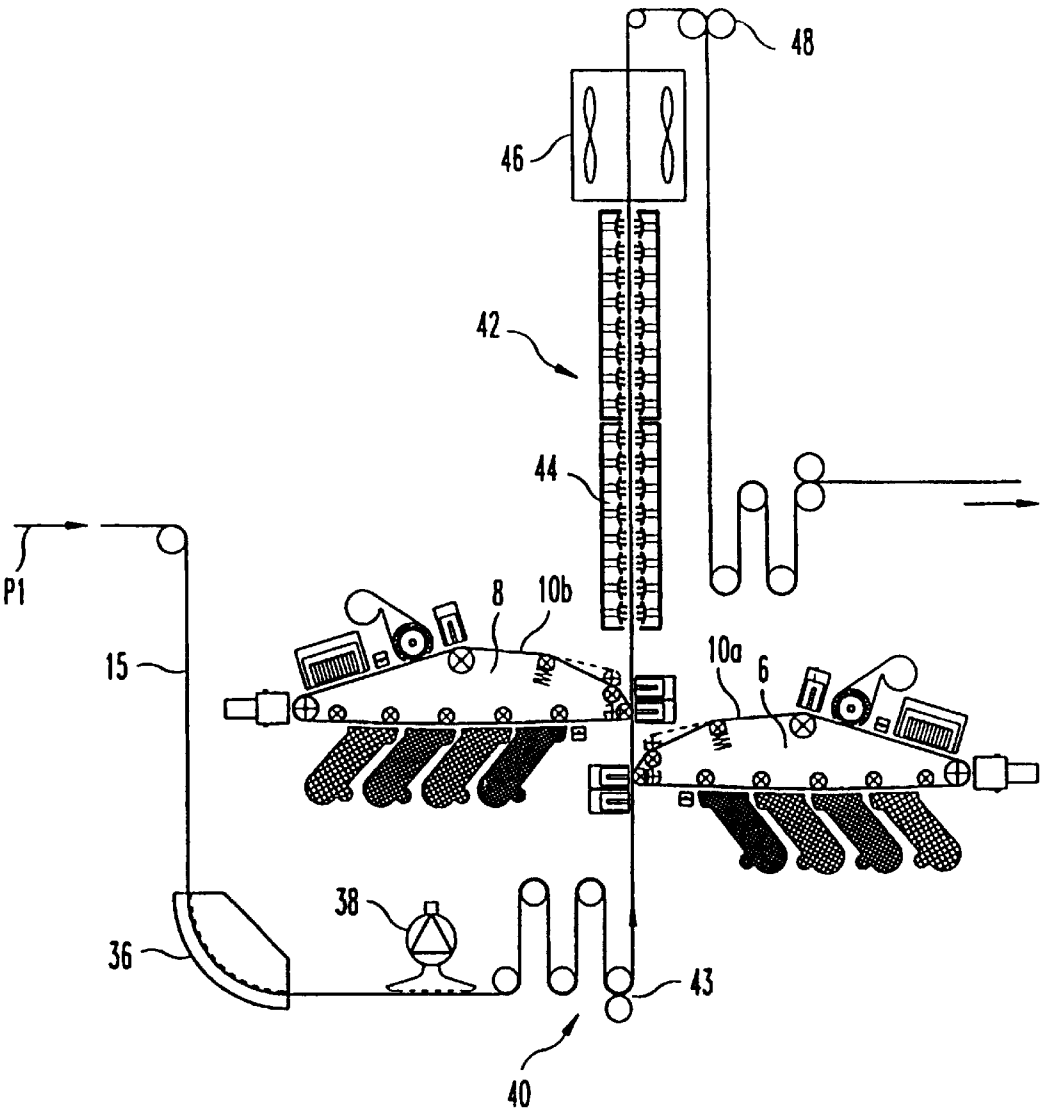
FIG. 5 is a schematic view of a printer means of the species of FIG. 2 with vertically proceeding carrier webs.

FIG. 5 shows a further example, whereby the paper web 15 is moved in vertical direction for printing through the two printing units 6, 8 and through the fixing device. The printing units 6, 8 are constructed as shown in FIG. 2. This arrangement has the advantage that the paper web 15 cannot sag between the transfer printing location of the last printing unit 8 and the transport roller pair 48 due to its dead weight. The risk of injury to and smearing of the print image during conveying along a long fixing path is thereby avoided. The longitudinal axes of the loops of the photoconductor bands 10*a*, 10*b* of the printer units 6, 8 are arranged essentially horizontally in this case.

Figure 6:
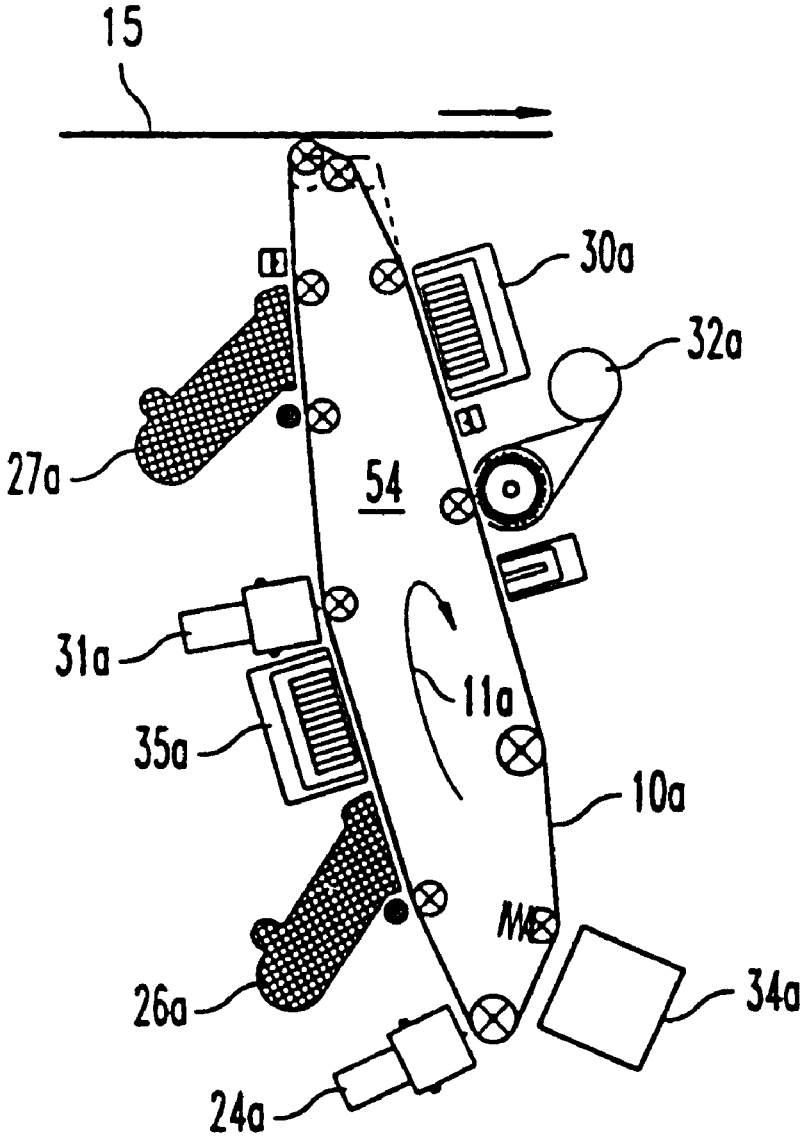
FIG. 6 is a schematic view of an arrangement having two illumination units and two developer stations in a printing unit.

FIG. 6 shows a printer device with a printing unit 54 that is constructed in the fashion of the printing unit 6 of FIG. 1. Identical parts are identically referenced. In addition to the printing unit of FIG. 6, the printing unit 54 contains a second charging corotron 35*a,* a second line generator 31*a* and a second developing station 27*a.* Upon circulation of the photoconductor band 10*a*, a first latent charge image is generated by the charging corotron 34*a,* 20*a* and the line generator 24*a* according to a method developed by Océ Printing Systems GmbH, and a first toner image is then generated by the developer station 26*a.* Subsequently, the second character generator 31*a,* in conjunction with the charging corotron 35*a,* generates a second latent charge image by superimposition on the developed, first charge image, this second latent charge image being developed by the developer station 27*a.* The two developer stations 26*a,* 27*a* preferably have different toner colors. A further toner image is thus superimposed on the first toner image on the photoconductor band 10*a*. The resulting toner image is then transferred onto the paper web 15 at the transfer printing location. In this way, a two-color toner image can be printed with high printing speed at the transfer printing location. It is also possible to provide a further charging corotron, a further illumination unit and a further developer station, preferably with a further toner color, along the photoconductor band 10*a* in order to superimpose more than two toner images on the photoconductor band, these then being transferred onto the paper web 15 in common.

Figure 7:
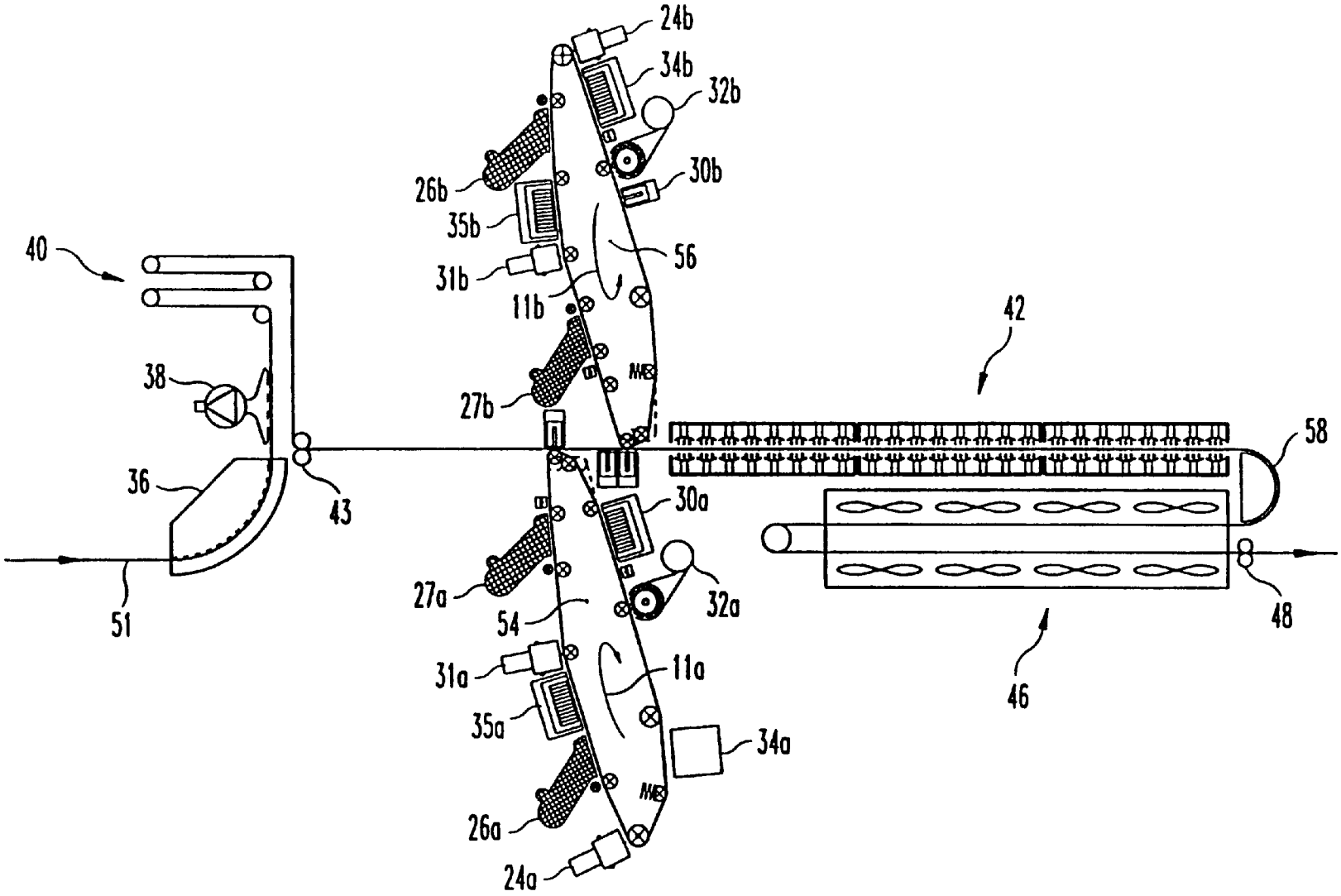
FIG. 7 is a schematic view of the paired arranged of printing units according to FIG. 6 with inclined longitudinal axis.

The printing unit 54 shown in FIG. 6 can be utilized in various versions according to the principles shown in FIGS. 1 through 5. In FIG. 7, for example, an identical printer unit 56 is arranged lying opposite the printing unit 54. The overall arrangement essentially agrees with that of FIG. 1. Identical parts are again identically referenced. After traversal of the fixing device 42, the paper web is deflected quasi contact-free at a deflection means 58 that generates an air pillow, and is supplied to the cooling device 46. A two-color duplex printing mode is possible with high printing speed given the printer device shown in FIG. 7.

Figure 8:
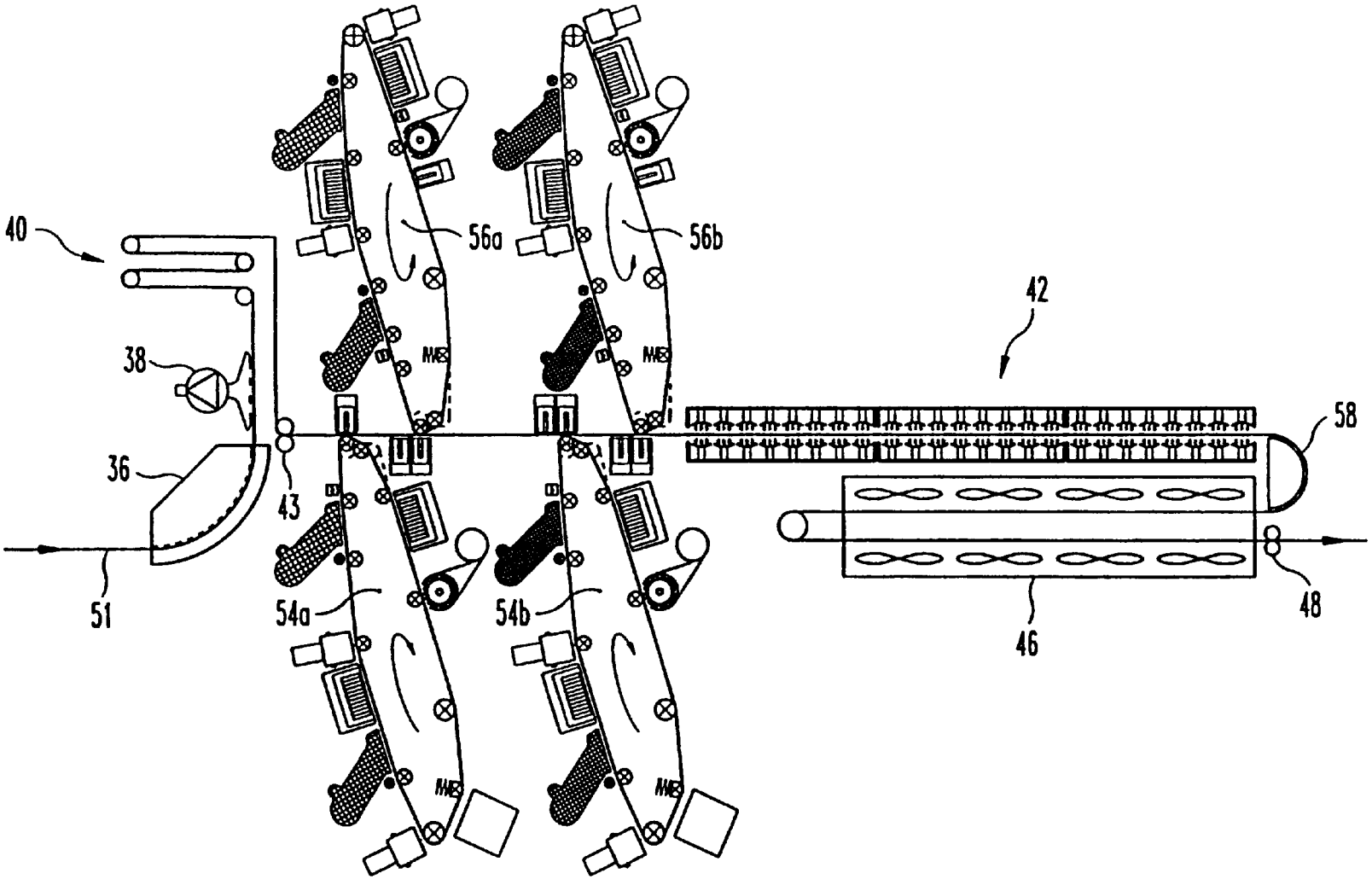
FIG. 8 is a schematic view of an arrangement having two pair of printing units according to FIG. 6.

FIG. 8 shows a further version wherein two pair of printing units are connected following one another in the fashion of the printing unit pair 54, 56. Each printing unit 54*a,* 54*b,* 56*a,* 56*b* can apply a two-color toner image on a respective side of the paper web without repetition. Due to the arrangement with the short paper path between the first printing unit 54*a* and the last printing unit 56*b,* high registration is achieved. A four-color duplex printing mode can be realized. When the process colors yellow, magenta, cyan and black are employed as toners in the developer stations, a full-color printing on both sides of the paper web 15 is possible given appropriate process management, without having to print in repetitive fashion.

Figure 9:
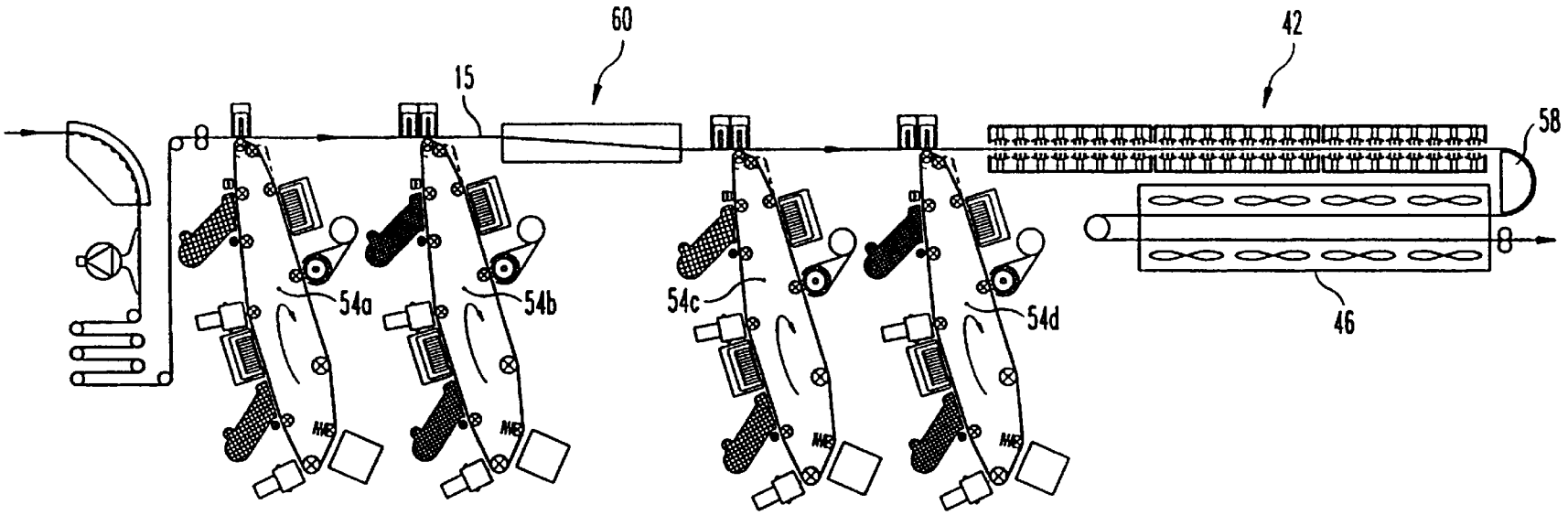
FIG. 9 is a schematic view of an arrangement having four printing units according to FIG. 6, whereby the carrier web is turned respectively over between two respective printing units.

FIG. 9 shows a version with four identical printing units 54*a,* 54*b,* 54*c,* 54*d* that are each respectively constructed in the fashion of the printer unit shown in FIG. 6. A turn-over means 60 that turns the paper web 15 over is arranged between the printing units 54*a,* 54*b* and the printing units 54*c,* 54*d.* A four-color duplex printing mode with high printing speed can likewise be realized with this arrangement without having to repeat the paper web 15. The arrangement of FIG. 9 has the advantage that the structural height of the printer accepting the printing units 54*a* through 54*d* in a housing can be substantially reduced. The turn-over means 60 is implemented as a cross-type turner, whereby the toner image printed on the underside of the paper web 15 by the printing units 54*a,* 54*b* is not mechanically damaged.

List of Reference Characters

| | |
|---|---|
| 6, 8 | printing unit |
| 10a, 10b | photoconductor web |
| 12a, 12b | transfer printing location |
| 11a, 11b | rotational sense arrow |
| 14a, 14b | transfer drum |
| 16a, 16b | transfer printing corotron |
| 18a, 18b | conditioning corotron |
| 20a, 20b | deflection drum |
| 22a, 22b | tension element |
| 24a, 24b | character generator |
| 26a, 26b | developer station |
| 27a, 27b | developer station |
| 28a, 28b | swivel mechanism |
| 30a, 30b | cleaning corotron |
| 32a, 32b | cleaning station |
| 34a, 34b | charging corotron |
| 35a, 35b | charging corotron |
| 36 | transverse alignment device |
| 38 | under-pressure brake |
| 40 | lateral guidance means |
| 42 | fixing means |
| 43 | friction drum pair |
| 44 | fixing path |
| 46 | cooling device |
| 48 | transport roller pair |
| 50a, 50b, 50c, 50d | developer station |
| 52a, 52b | developer station |
| 54, 56 | printing unit |
| 58 | deflection means |
| 60 | turn-over means |
| P1 | conveying direction arrow |

From the above description, it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed is:

1. An electrographic printer device comprising:

at least two printing units each comprising a respective transfer printing location between which a carrier web to be printed is conducted, the transfer printing locations being disposed opposite the web from one another and laterally offset from one another, each printing unit further comprising a toner carrier band comprising an endless outer circumferential surface that extends around its respective transfer printing location and on which toner can be applied in an image-shaped distribution, the toner being transferrable from the toner carrier band to the carrier web at the respective transfer printing location as the carrier web passes the respective toner carrier band at the respective transfer printing location, each printing unit further comprising a swivel mechanism at least partially disposed inside the toner carrier band for moving the toner carrier band away from the carrier web only at the transfer printing location, each printing unit further comprising a tensioning element disposed inside the toner carrier band for applying tension to the toner carrier band.

2. The printer device of claim 1 wherein the carrier web is conducted horizontally.

3. The printer device of claim 1 wherein the toner carrier bands of the two printing units each form an elongated loop, each longitudinal loop having a longitudinal axis, the longitudinal axes of the two loops extending vertically.

4. The printer device of claim 1 wherein each toner carrier band forms an elongated loop, each longitudinal loop having a longitudinal axis, the longitudinal axes of the two loops extending at an angle of 15° with respect to vertical, and the longitudinal axes are parallel to one another.

5. The printer device of claim 1 wherein each toner carrier band is a photoconductor band and the outer circumferential surface of each toner carrier band can be completely charged with a latent charge image.

6. The printer device of claim 1 wherein each printing unit further comprises at least one illumination unit selected from the group consisting of a laser illumination unit and a LED illumination unit.

7. The printer device of claim 6 wherein each printing unit further comprises a deflection drum disposed inside the toner carrier band and at an opposing end of the toner carrier band from the transfer printing location and the illumination unit of each printing unit is disposed opposite the toner carrier band from the deflection drum.

8. The printer device of claim 1 wherein each printing unit further comprises a plurality of developer stations.

9. The printer device of claim 8 wherein each printing unit further comprises four developer stations, each developer station accommodating toner in four process colors for full-color printing.

10. The printer device of claim 1 wherein the carrier web can conducted past the respective transfer printing locations with a forward motion and a reverse motion, and a toner image is transferred onto the carrier web given every passage in forward direction.

11. The printer device of claim 10 wherein the toner carrier band is moved away from the carrier web given every reverse motion thereof.

12. The printer device of claim 1 further comprising a pair of further printing units disposed on opposing sides of the carrier web and downstream of said at least two printing units.

13. The printer device of claim 1 further comprising a fixing means that fixes a toner image on the carrier web.

14. The printer device of claim 13 wherein the fixing means comprises a horizontal fixing path.

15. The printer device of claim 13 wherein the fixing means comprises a vertical fixing path.

16. The printer device of claim 1 each printing unit comprises at least two illumination units, at least two charging corona devices and at least two developer stations, the illumination units, charging corona devices and developer stations being disposed along the outer circumference of their respective toner carrier bands, the illumination units generating two latent images on their respective toner carrier band that can be superimposed on one another and that can be successively coated with toner by the respective developer stations.

17. The printer device of claim 16 wherein the toners distributed by the developer stations are of different colors.

18. The printer device of claim 1 wherein each printing unit further comprises a transfer printing corotron disposed at the transfer printing location, and a conditioning corotron disposed adjacent to and upstream of the transfer printing corotron as viewed in conveying direction of the carrier web.

19. The printer device of claim 18 wherein each printing unit further comprises a transfer printing corotron disposed at the transfer printing location, and a conditioning corotron disposed adjacent to and downstream of the transfer printing corotron as viewed in conveying direction of the carrier web.

20. The printer device of claim 1 wherein, when each toner carrier band is moved away from the carrier web by its respective swivel mechanism, a plurality of toner images are collected on the toner carrier band which are subsequently transfer-printed onto the carrier web as superimposed toner images.

21. A method for operating an electrophotographic printer device that includes at least two printing units each comprising a respective transfer printing location between which a carrier web to be printed is conducted, the transfer printing locations being disposed opposite the web from one another and laterally offset from one another, each printing unit further comprising a toner carrier band comprising an endless outer circumferential surface that extends around its respective transfer printing location and on which toner can be applied in an image-shaped distribution, the toner being transferrable from the toner carrier band to the carrier web at the respective transfer printing location as the carrier web passes the respective toner carrier band at the respective transfer printing location, each printing unit further comprising a swivel mechanism at least partially disposed inside the toner carrier band for moving the toner carrier band away from the carrier web only at the transfer printing location, each printing unit further comprising a tensioning element disposed inside the toner carrier band for applying tension to the toner carrier band, each printing unit further comprising a plurality of developer stations, the method comprising the following steps:

supplying a carrier web to the printing units, applying toner to the outer circumferences of the toner carrier bands in image-shaped distributions, conducting the toner carrier band past the transfer printing location in a forward direction, transferring toner from each toner carrier band to the carrier web at each respective transfer printing location, moving the toner carrier bands away from the carrier web only at the transfer printing locations with the respective swivel mechanisms, conducting the toner carrier bands past the transfer printing locations in a reverse direction, moving the toner carrier bands towards the carrier web only at the transfer printing locations with the respective swivel mechanisms, conducting the toner carrier band past the transfer printing location in a forward direction, transferring toner from each toner carrier band to the carrier web at each respective transfer printing location, applying tension to the toner carrier bands when they are moving in both the forward and reverse directions.

22. The method of claim 21 wherein each printing unit comprises four developer stations having toner in four process colors for full-color printing.

23. The method of claim 21 wherein further comprising a turn-over means disposed between two printing units for turning the carrier web over.

* * * * *